United States Patent [19]

Inoue

[11] Patent Number: 4,674,235

[45] Date of Patent: Jun. 23, 1987

[54] GRINDING WHEEL CRACK DETECTOR AND METHOD

[75] Inventor: Kiyoshi Inoue, Tokyo, Japan

[73] Assignee: Inoue-Japax Research Incorporated, Kanagawaken, Japan

[21] Appl. No.: 416,129

[22] Filed: Sep. 9, 1982

Related U.S. Application Data

[63] Continuation of Ser. No. 187,058, Sep. 15, 1980, abandoned.

[30] Foreign Application Priority Data

Sep. 18, 1979 [JP] Japan ..... 54-118818

[51] Int. Cl.[4] ..... B24B 1/00

[52] U.S. Cl. ..... 51/281 R; 51/206 R; 51/134.5 R; 324/52

[58] Field of Search ..... 51/206 R, 165 R, 209 R, 51/281 R, 134.5 R; 324/52; 338/307; 427/98

[56] References Cited

U.S. PATENT DOCUMENTS

| | | | |
|---|---|---|---|
| 2,795,680 | 6/1957 | Peck | 338/307 |
| 2,947,121 | 8/1960 | Coes | 51/206 R |
| 3,307,972 | 3/1967 | Earhardt | 427/98 |
| 3,477,019 | 11/1969 | Hartmann | 324/52 |
| 3,609,495 | 9/1971 | Seesselberg | 188/158 |
| 4,006,269 | 2/1977 | Kerfoot | 427/98 |
| 4,137,516 | 1/1979 | Shaw et al. | 51/206 R |

*Primary Examiner*—Frederick R. Schmidt
*Assistant Examiner*—Robert A. Rose
*Attorney, Agent, or Firm*—Karl F. Ross; Herbert Dubno

[57] ABSTRACT

A grinding wheel capable of detecting and a method of monitoring it to detect, the development of a crack or like damage therein are disclosed. The wheel is constituted of an electrically nonconductive body having an electrically conductive strip, e.g. a thin film of an electrically conductive ink printed, of an electrically conductive paint applied, of a metal electrolessly or chemically deposited or of a metal electrolytically deposited, in a pattern, say, of quasi-circular or spiral configuration, on a portion of at least one side surface of the body. A current source is connected to the opposite ends of the conductive strip to pass an electric circuit therethrough. When a crack or like damage develops in the wheel body being rotated to perform a grinding operation, the circuit will be broken or a change in the current will occur, signaling the damage or crack formation.

27 Claims, 5 Drawing Figures

GRINDING WHEEL CRACK DETECTOR AND METHOD

This application is a continuation of application Ser. No. 187,058 filed Sept. 15, 1980, now abandoned.

FIELD OF THE INVENTION

The present invention relates to grinding wheels and, more particularly, to a method of detecting a crack or like damage generated in a grinding wheel when in use or used for grinding a workpiece or workpieces, as well as to a grinding wheel capable of signaling the generation of a crack therein.

BACKGROUND OF THE INVENTION

Various sorts of grinding wheels have been widely used in diverse of applications with a variety of equipment ranging from simple hand grinders to heavy-load and high-precision grinding machines. Pratically in every application, a grinding wheel during its service or during its high-velocity rotation in abrasive or machining contact with workpieces tends to develop a crack or other damage. This, when it happens, may seriously reduce the machining accuracy and may often cause a serious accident or injury which cannot normally be anticipated. While frequent inspection for damage of a grinding wheel in service and its consequential replacement with a new wheel are thus required, it is quite difficult, if not impossible, to detect such damage with the naked eye, especially a wheel in rotation or during machining.

OBJECTS OF THE INVENTION

It is, accordingly, an important object of the present invention to provide a method of monitoring a grinding wheel whereby a crack or like damage when generated therein can be ascertained readily and promptly.

Another object of the invention is to provide a grinding wheel capable of signaling the formation of a crack or like damage promptly to the operator's attention.

Still another object of the invention is to provide a grinding machine incorporating such a wheel and adapted to carry out such a method.

SUMMARY OF THE INVENTION

The present invention in principle is applicable to an electrically nonconductive grinding or abrasive wheel. Every conventional grinding wheel has two constituents, the abrasive that does the cutting and the binder that holds the abrasive grains. Variations of these constituents can be selected to give a large number of combinations (cf,. for example, Metals Handbook, vol. 3, machining, 8th Edition, American Society of Metals, pages 257–258). The abrasive is naturally or practically nonconductive and the binder also is typically electrically nonconductive except for some special wheels such as a metal-bonded electrolytic grinding wheel. Thus, practically any conventional grinding wheel can be considered to be a "grinding wheel" for the purpose of the invention including vitrified, silicate, rubber, rubber reinforced, resinoid, resinoid reinforced, shellac or oxychloride bonded abrasive bodies of diamond, silicon carbide, boron carbide, boron nitride, aluminum oxide, zirconium oxide, zinc oxide or titanium oxide.

In accordance with the present invention there is provided a grinding wheel constituted of an electrically non-conductive grinding body in the form of a wheel and having an electrically conductive strip attached on at least one circular zone or zone of circularity on at least one side surface of the body and remote by more than a preselected distance from the pheriphery of the wheel, the strip having its opposite ends connectable to a power supply to form an electric circuit therewith and being adapted to break the electric circuit or to change an electrical characteristic of the circuit when a crack or like damage is generated in the said zone of the body, thereby signaling the generation of such damage in the grinding wheel.

In a method aspect of the invention, there is provided a method of monitoring a grinding wheel consituted of an electrically nonconductive grinding body in the form of a wheel to detect a crack or like damage when generated therein, the method comprising the steps of: attaching an electrically conductive strip on at least one circular zone or zone of circularity on at least one side surface of the body and remote by more than a preselected distance from the periphery of the wheel connecting the opposite ends of the conductive strip to a current supply to form an electric circuit therewith and sensing a change in an electrical characteristic of the circuit occurring in response to development of a crack or like damage in the body.

Specifically the change in the characteristic of the said electric circuit may occur an interruption the circuit or as a change is electrical ressitance of the circuit when a crack or like damage develops in the body.

The invention also provides a grinding machine comprising a grinding wheel constituted of an electrically nonconductive grinding body in the form of a wheel having an electrically conductive strip attached on a portion of at least one side surface of the body and remote by more than a preselected distance from the periphery of the wheel, a current supply connectable to the opposite ends of the conductive strip to form an electric circuit for passing an electric current through the conductive strip and sensing means responsive to a change in the electric current through the circuit which occurs upon a breaking thereof or as a change in electrical resistance thereof for representing development of a crack or like damage in the said body.

Specifically, the electrically conductive strip may be a thin film of an electrically conductive ink or paint printed, or a metal electrolessly or chemically deposited or a metal electrolytically deposited, in a suitable pattern, e.g. in the form of a quasi-circle, a spiral or a straight or curved elongate stripe, on the said portion.

BRIEF DESCRIPTION OF THE DRAWING

These and other objects, features and advantages of the present invention will become more readily apparent from a reading of the following description of certain embodiments thereof, reference being made to the accompanying drawing in which.

SPECIFIC DESCRIPTION

Figure 2:
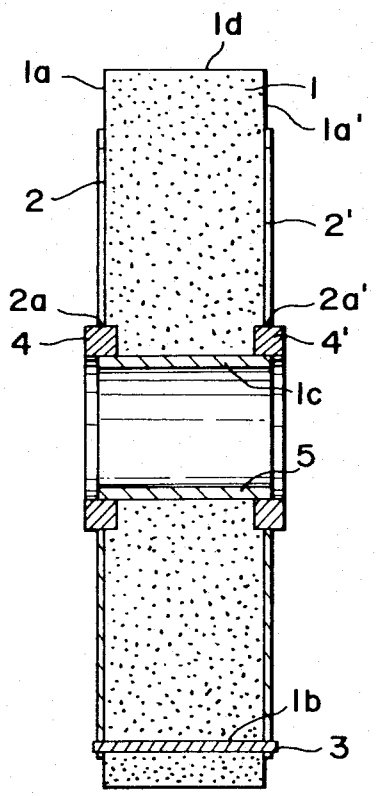
FIG. 2 is a front sectional view of the grinding wheel taken along the line II—II in FIG. 1.
Figure 1:
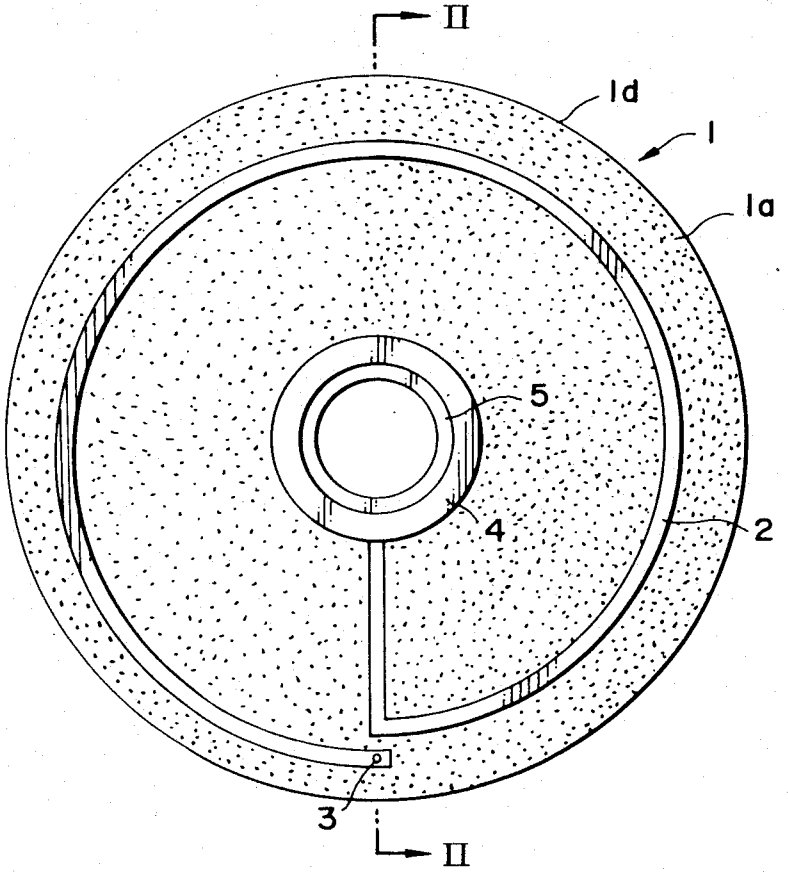
FIG. 1 is a side view diagrammatically illustrating a grinding wheel having a single generally circular electrically conductive strip on each side thereof, according to the invention, the strips on opposite sides being connected to each other by a conductor embedded in the wheel body and bridging the two side surfaces.

In the device of FIGS. 1 and 2, an electrically nonconductive grinding wheel 1, for example, of vitrified bonded type, has attached on each of the two side surfaces 1*a* and 1*a*′ thereof a respective electrically conductive strip 2, 2′ each in a thin quasi-circle or quasi-ring shaped film of a predetermined thickness. The two strips 2 and 2′ are connected together by a conductor 3 received in a bore 1*b* drilled through the body of the wheel transversely to the side surfaces 1*a* and 1*a*′ and have end portions 2*a* and 2*a*′ arranged in electrical contact with metallic or other electrically conductive rings 4 and 4′ fitted to the wheel 1 and on an insulating tubular sleeve 5 fitted into the central opening 1*c* of the wheel 1.

The conductive strip 2′ on the rear side 1*a*′ of the wheel 1 may be of a pattern identical to or symmetrical about the plane II—II with, the pattern of the conductive strip 2 on the front side 1*a* shown in FIG. 1.

Accordingly, there is formed a continuous electrically conductive passage on the side surfaces 1*a* and 1*a*′ across the conductive rings 4 and 4′ by the conductive strips 2 and 2′ electrically bridged by the conductor 3.

Each strip 2, 2′ may be an adherent film screen-printed from an ink or paint containing electrically conductive (metallic) particles or electrolytically, or electrolessly or chemically deposited, on the side surface 1*a*, 1*a*′ of the wheel 1 such that it breaks readily when a crack or like damage is generated in a region of the body of the wheel 1 beneath it.

As is apparent, it is desirable not to use as a source of the film a paint which shrinks to form in situ cracks therein after drying or such a thich metallic film as to have a high tensile strength.

Each strip 2, 2′ may be coated with a wear-resistant protective paint or like film which may be electrically nonconductive and which protects it against destruction due to any external cause (such as a scratch) other than the formation of a crack in the body of the wheel 1.

The interfaces between the strip 2, 2′ and each conductive ring 4, 4′ and between each strip 2, 28 and the conductor 3 may be coated with a conductive paint or adhesive to complete the electrical connections therewith.

Various patterns are contemplated to shape the electrically conductive strips 2, 2′. It is desirable that the strips should cover all radial directions of the wheel 1 and hence be generally circular or ring-shaped.

Each circular or ring-shaped strip 2, 2′ should be located as to be remote by more than a preselected distance from the periphery 1*d* of the wheel 1 which serves as a grinding surface and hence is subjected to wear, the particular distance depending upon the size of the wheel 1 and the expected amount of its wear at the periphery 1*d*.

Figure 3:
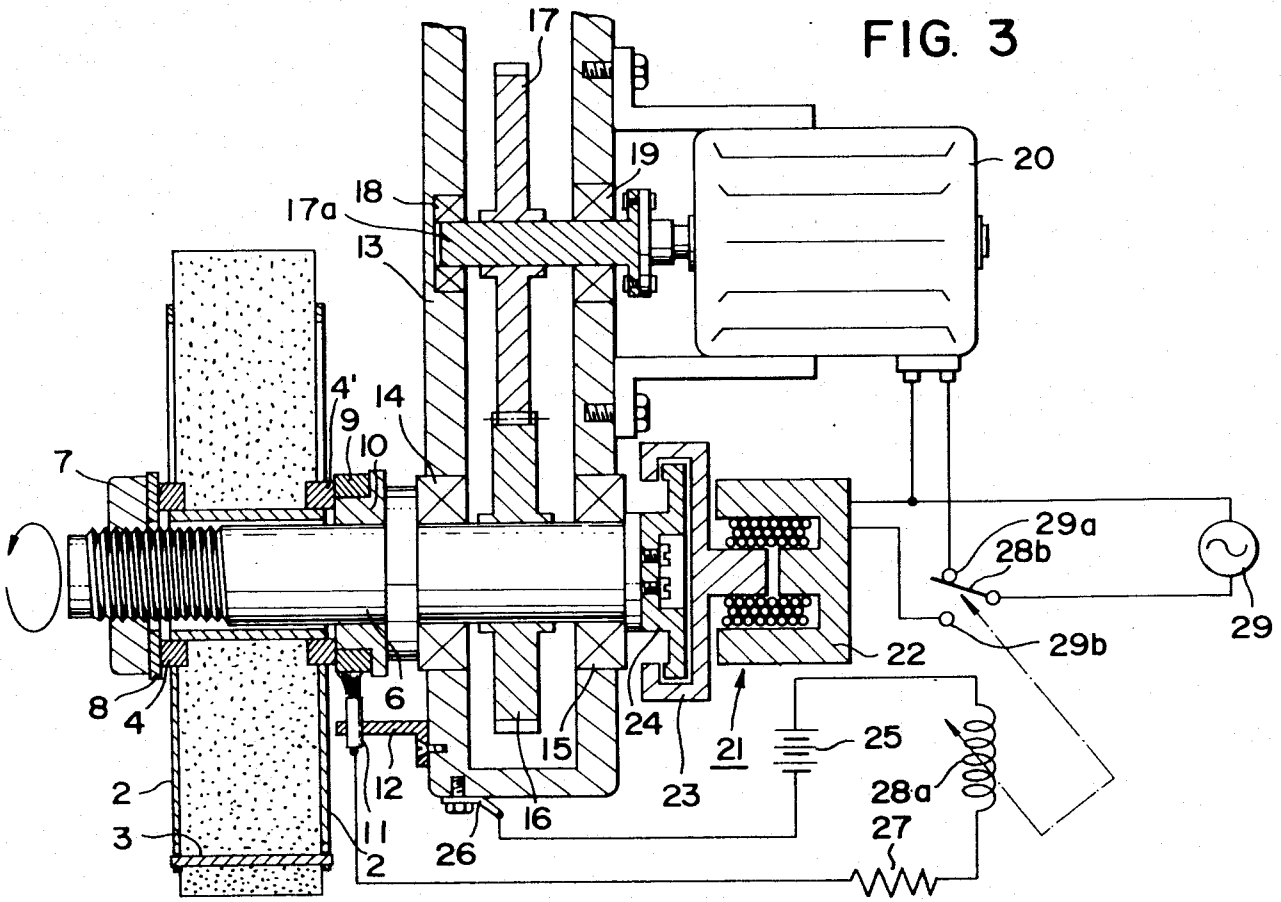
FIG. 3 is a front view generally in section diagrammatically illustrating an essential portion of a grinding machine embodying the present invention with a grinding wheel as illustrated in FIGS. 1 and 2.

In FIG. 3 there is shown an essential portion of a grinding apparatus operated with a grinding wheel 1 as has been described according to the invention. The wheel 1 is shown mounted on a metallic rotary shaft or spindle 6 by means of a metallic clamping nut 7 with a metallic washer 8 interposed between the ring 4 and the nut 7. In contact with the other ring 4′, a further conducting ring 9 is securely seated on the shoulder of an insulating sleeve 10 which in turn is securely fitted onto the spindle 6 and is also arranged in engagement with a conducting brush 11 securely carried on an insulating support 12, a metallic frame 13 carrying the support 12 is mounted to carry the spindle 6 rotatably via metallic bearings 14 and 15. Within the frame 13, the spindle 6 is securely carried by a drive gear 16 which is in turn in engagement with a transmission gear 17 whose shaft 17*a* is journaled via bearings 18 and 19 on the frame 13 and is driven by a motor 20 attached on an outer wall of the frame 18.

An electromagnetic brake unit 21 is also provided and includes an electromagnet 22, a brake element 23, and a brake disk 24 secured to the spindle 6. A DC source 25 is connected on one hand to a conducting terminal plate 26 secured to the metallic frame 3 and on the other to the brush 11 via a current limiting resistor 27 and a solenoid 28′ of a relay 28*a*. The latter has one contact 29*a* for connecting an AC source 29 to the motor 20 and the other contact 29*b* connecting the same to the energizing coil of the electromagnet 22.

With the contact of the relay 28 in the position shown (29*a*), the motor 20 is driven to rotate the spindle 6. The wheel 1 is thus rotated to perform a grinding operation on a workpiece (not shown). The direct current is then allowed to flow from the supply 25 via the solenoid 28*a*, the resistor 27, the brush 11, the conducting ring 9 on the insulating sleeve 10, one conducting ring 4′ on the wheel 1, the strip 2′ on one side surface 1*a*′, the conductor 3, the strip 2 on the other side surface 1*a*, the other conducting ring 4 on the wheel 1, the conductive washer 8, the conductive nut 7, the conductive spindle 6, the conductive bearings 14 and 15, the conductive frame 13 and conducting terminal plate 26 back to the supply 25. As long as the current continues to flow through the strips 2 and 2′ and thus the solenoid 28*a* remains energized, the relay contact position 29*a* is maintained to keep the motor 20 driven by the power supply 29 and hence the wheel 1 is kept rotating.

When a crack or like damage develops in a region of the body of the wheel 1, the strip or strips 2, 2′ will break. The solenoid 28*a* is then deenergized to switch moving contact of the relay 28 to the position 29*b*. This causes the motor 20 to be deenergized and at the same time the electromagnet 22 to be energized. The braking element 23 is then attracted to the right and comes into braking engagement with the disk 24 secured to the spindle 6. The wheel 1 is thus halted quickly or substantially instantaneously in response to the generation of a crack or like damage therein.

It will be apparent that any of various other manners of electrical sensing operation is possible with the conductive strip attachment arrangement shown and described. For example, an increase in electrical resistance of the strip 2, 2′ tending to break or being elongated in response to damage developing in the wheel 1 may be sensed as a fall in current drop from the sensing source 25. The fall in current drop can be detected as a voltage drop across the resistor 27, which can be applied to a threshold circuit, e.g. a Schmitt-trigger circuit, having a preset threshold or triggering level. When the latter is subjected to the sensed voltage, the circuit may provide an alarm signal or a control pulse which may be applied to deenergize the motor 20 and to actuate the electromagnetic brake unit 21.

It will be apparent that the control signal which develops at the solenoid coil 28*a* or any other detector as described may also be used to halt the worktable which carries the workpiece which has been under a machining feed thereby. The signal may also be used to operate an alarm device such as a bell.

Further, it is conceivable to constitute each conductive strip 2, 2' of a material which not only is electrically conductive but whose electrical properties change in response to a thermal or other deflection of the grinding wheel 1. When the strip 2, 2' makes use of an ink containing electrically conductive particles, a suitable amount of electrically non-conductive particles may also be incorporated therein to adjust the electrical resistance of the strip 2, 2'.

Figure 4:
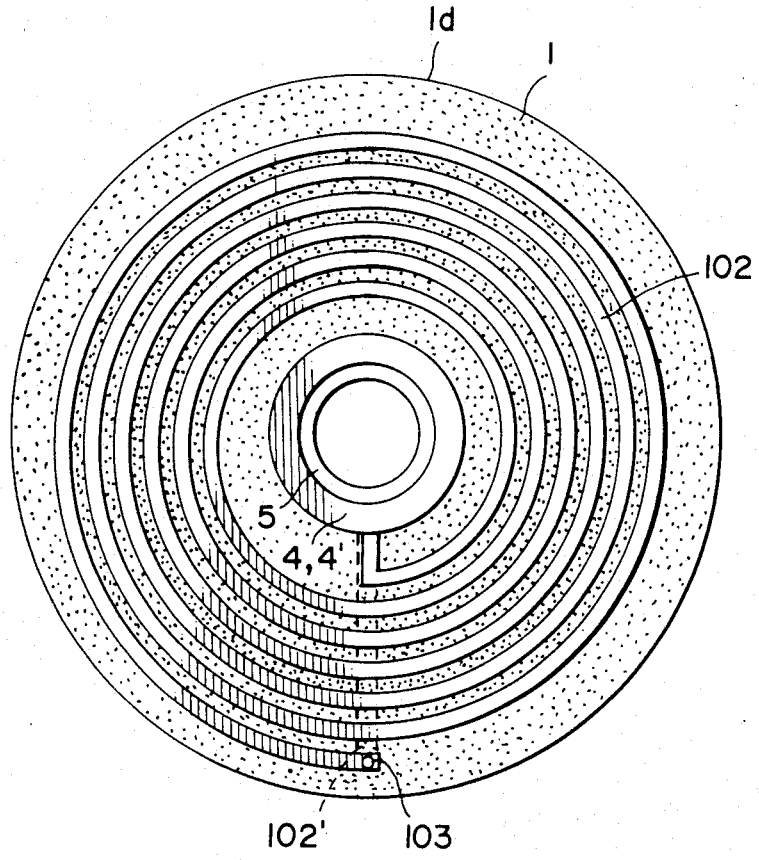
FIG. 4 is a side view diagrammatically illustrating a grinding wheel with a modified embodiment of the electrically conductive strip arranged in a spiral form according to the invention.

FIG. 4 shows a modified strip arrangement applied to the wheel 1 in accordance with the invention. In this example, the strip 102, 102' is patterned in a six-turn spiral form throughout an essential radial zone of the wheel 1 remote by a predetermined distance from the periphery 1*d* thereof. As in the embodiment of FIGS. 1 and 2, the strips 102 and 102' here may be identical to or symmetrical with each other and are connected together by the conductor 103 embedded in the body of the wheel 1. Alternatively, the strip 102' on the rear side surface may be a radial linear elongate band, as shown by broken lines, connecting the conductor 103 and the conducting ring 4'.

Figure 5:
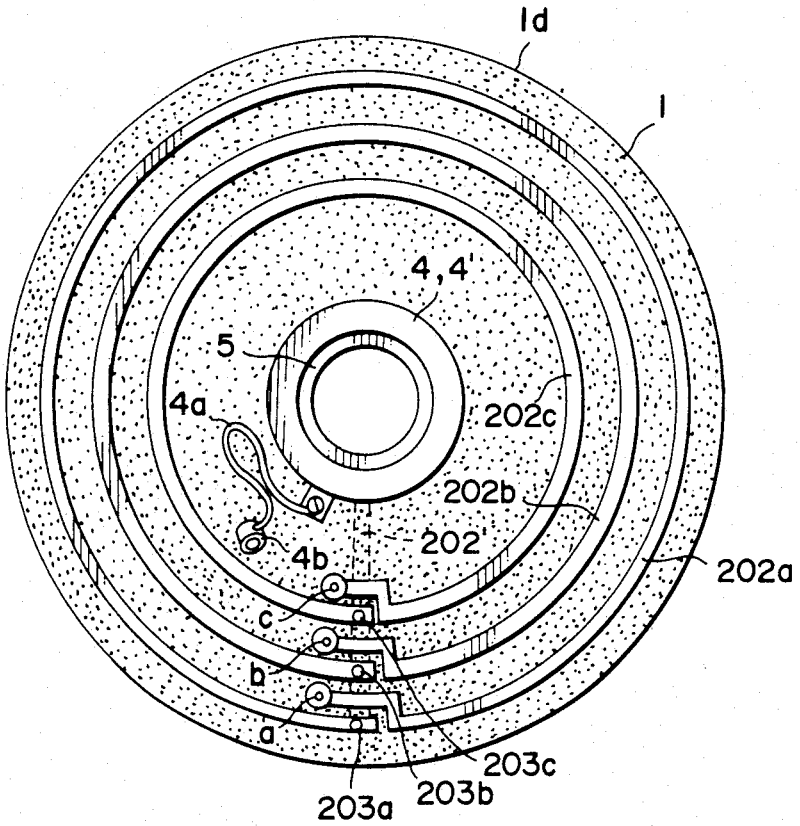
FIG. 5 is an elevational side view diagrammatically illustrating a grinding wheel with a further modified form of the electrically conductive strip arrangement according to the invention.

A modified form of the conductive strip 202 shown in FIG. 5 comprises three coaxial quasi-circles or quasi-rings, or sub-strips 202*a*, 202*b* and 202*c* of different radii. The conductive sub-strips 202*a*, 202*b* 202*c* on the front face 1*a* have at their respective one ends conductive projections a, b and c set into the body of the wheel 1 and have their respective end portions connected to conductors 203*a*, 203*b*, 203*c* which individually pass through the thickness of the wheel 1 to reach the straight radial elongate conductive strip 202' (shown by broken lines) on the rear face 1*a'*. The conducting ring 4 on the front face 1*a* has a flexible electric conductor 4*a* attached thereto, the conductor having a plug 4*b* at its free end which can selectively be fitted on the conductive projections a, b and c to complete the corresponding sub-circuits comprising the respective sub-strips 202*a*, 202*b* and 202*c*. Thus, in an initial stage of use of the grinding wheel 1, the plug 4*b* is fitted on the projections a so as to make the sub-strip 202*a* operative. When the wheel 1 suffers wear on its periphery surface 1*d* and the wear reaches the sub-strip 202*a*, the plug 4*b* is switched to the projection b so as to make the sub-strip 202*b* operative. Thereafter, when the wheel wear reaches the sub-strip 202*c*, the plug 4*b* is switched to the projection c so as to make the sub-strip 202*c* operative.

It will be appreciated that various other forms of patterning the conductive strips on the wheel 1 are possible and that the invention is not intended to be limited to any of the specific forms shown and described.

There is thus provided an improved grinding wheel as well as an improved method and apparatus for monitoring the grinding wheel, and a grinding method and apparatus using the improved grinding wheel, by virtue of which almost any crack or like damage in the body of a grinding wheel can be detected and ascertained immediately upon its development so as to permit an alarm signal to be emitted and/or the wheel to be brought to a halt quickly so that any potential injury to the operator and detrimental effects on the machining results may be effectively prevented.

What is claimed is:

1. A grinding wheel constituted of an annular electrically nonconductive grinding body in the form of a rotatable wheel having a central bore for receiving an electrically conductive spindle, characterized by having:

a pair of electrically conductive strips, each of said strips being attached on a portion of each of two opposite, parallel side surfaces of the body remote by more than a preselected distance from the periphery of said wheel and spaced outwardly from said bore, each of said strips extending through at least one turn on each respective said side surface around the axis of the wheel continuously from one end of each said strip closer to said periphery to the other end of the strip closer to said bore;

a conductor traversing said body of the wheel across its thickness for interconnecting said respective one ends of the conductive strips on said side surfaces;

a pair of conductive rings fitted onto said side surfaces of the wheel around said bore for establishing an electrical contact with said other ends of the conductive strips, respectively and connectable to a power supply to form an electric circuit therewith through said conductive strips and said spindle, and to enable said conductive strips to change the electrical characteristic of said circuit when a crack or like damage is caused in said body, thereby signaling the generation thereof in said grinding wheel; and an insulating sleeve received in said bore and in said rings for receiving said spindle and electrically insulating the latter from said conductive rings.

2. The grinding wheel defined in claim 1 wherein the pattern of said strip is identical on the opposite side surfaces of said body.

3. The grinding wheel according to claim 1 wherein each of said conductive strips is patterned in the form of a quasi-circle.

4. The grinding wheel according to claim 1 wherein each of said conductive strips includes a straight elongate element in a radial direction of said wheel.

5. The grinding wheel according to claim 1 wherein each of said conductive strips is patterned in the form of a spiral.

6. The grinding wheel according to claim 4 wherein each of said conductive strips is a thin film of an electrically conductive ink or paint printed on said portion, thereby forming an electric circuit between said supply and said strips;

7. The grinding wheel according to claim 4 wherein each of said conductive strips is a thin film of metal electrolessly or chemically deposited on said portion.

8. The grinding wheel according to claim 4 wherein each of said conductive strips is a thin film of a metal electrolytically deposited on said portion.

9. A method of monitoring a grinding wheel mounted on an electrically conductive spindle and constituted of an annular electrically nonconductive grinding body in the form of a wheel having a central bore receiving said spindle to detect a crack or like damage in said body, the method comprising the steps of:

attaching a respective electrically conductive strip on at least a portion of each of two opposite side surfaces of said wheel and remote by more than a preselected distance from the periphery of said wheel such that each said strip extends through at least one turn on the respective one of said side surfaces around the axis of the said wheel, continuously from one end of each said strip closer to said periphery to the other end of the strip closer to said bore;

electrically connecting said one ends of said conductive strips together by means of a conductor traversing said body of the wheel across its thickness;

fitting a conductive ring onto each of said side surfaces of the wheel around said bore and connecting said other end of each of said strips to the respective conductive ring to establish an electrical contact therewith;

inhibiting a direct electrical connection between said conductive spindle and each of conductive rings by disposing an insulating sleeve in said bore so as to receive said spindle therein and to bridge across said rings;

connecting said rings to a current supply by connecting one of said rings to a terminal of said supply and the other of said rings to another terminal of said supply via a further conductive ring secured on said spindle and disposed in a slidable contact with said other ring, thereby forming an electrical circuit between said supply and said strips;

rotating said wheel by rotationally driving said spindle;

sensing a change in the electric characteristic of said circuit occurring in response to development of a crack or like damage in said body while said wheel is in rotation; and terminating the drive of said spindle and braking same upon sensing of said change.

10. The method defined in claim 9 wherein said change in the characteristic of the electric circuit occurs in the form of a breaking of said circuit.

11. The method defined in claim 9 wherein said change in characteristic of the electric circuit occurs in the form of a change in resistance of said circuit.

12. The method defined in claim 9 wherein each conductive strip is patterned in the form of a quasi-circle.

13. The method defined in claim 9 wherein each conductive strip is patterned in the form of a spiral.

14. The method defined in claim 9 wherein each conductive strip includes a straight elongate element extending in a radial direction.

15. The method defined in claim 9 wherein said conductive strip is a thin film of an electrically conductive ink or paint printed on said portion.

16. The method defined in claim 9 wherein said conductive strip is a thin film of a metal electrolessly or chemically deposited on said portion.

17. The method defined in claim 9 wherein each conductive strip is a thin film of a metal electrolytically deposited on said portion.

18. A grinding machine comprising an electrically conductive spindle, a motor drivingly connected to said spindle, and a grinding wheel mounted on said spindle and constituted of an annular electrically nonconductive grinding body in the form of a wheel having a central bore receiving said spindle and a respective electrically conductive strip attached on a portion of each of two opposite, parallel side surfaces of said body remote by more than a preselected distance from the periphery of said wheel and spaced from said bore such that each of said strips extends through at least one turn on each respective said side surface around the axis of said wheel continuously from one end of each strip closer to said periphery to the other end of the strip closer to said bore, a current supply connectable to said other ends of said conductive strips to pass an electric current through said conductive strips and sensing means in circuit with said strips responsive to a change in said electric current for representing development of a crack or like damage in said body, said one ends of said conductive strips being interconnected by a conductor traversing said body across the thickness thereof, said one ends of the strips being each connected to a respective conductive ring attached on a respective side of said body around said bore, and an insulating sleeve being received in said bore so as to bridge across said rings and traversed by said spindle, said spindle being connected with one terminal of said current supply and carrying a conductive element engaging one of said rings, said curent supply having the other terminal connected with the other of said rings.

19. The grinding machine defined in claim 18 wherein:

said spindle is formed with a nut bearing axially on said one ring via said conductive element, said spindle being surrounded by an annular insulating member having a conductive portion bearing on said other ring axially, said conductive portion being engaged by a brush connected to said other terminal of said current supply, said one terminal of said curent supply being connected to said spindle via a conductive housing in which said spindle is journaled in electrical conductive relationship therewith.

20. The grinding machine defined in claim 18 wherein an electromagnetically actuatable brake is adapted to act directly on said spindle and an electric motor is operatively connected to said spindle by gearing, said circuit including a relay having contacts connecting said electric motor to a source of electric current in the absence of a change detected by said sensing means and for cutting off said electric motor and connecting said electromagnetic brake upon the detection of said change by said sensing means resulting in the switching of said relay.

21. The machine according to claim 18 wherein said conductive strip is patterned in the form of a quasi-circle.

22. The machine according to claim 18 wherein each conductive strip is patterned in the form of a spiral.

23. The machine according to claim 18 wherein each conductive strip includes an elongate element generally extending in a radial direction.

24. The machine according to claim 18 wherein each conductive strip is a thin film of an electrically conductive ink printed on said portion.

25. The machine according to claim 18 wherein each conductive strip is a thin film of an electrically conductive paint applied on said portion.

26. The machine according to claim 18 wherein each conductive strip is a thin film of a metal electrolessly or chemically deposited on said portion.

27. The machine according to claim 18 wherein each conductive strip is a thin film of a metal electrolytically deposited on said portion.

* * * * *